US010425719B2

(12) United States Patent
Combest

(10) Patent No.: US 10,425,719 B2
(45) **Date of Patent: *Sep. 24, 2019**

(54) OUTDOOR SPEAKER ASSEMBLY AND SYSTEM

(71) Applicant: MS ELECTRONICS, LLC, Overland Park, KS (US)

(72) Inventor: Chris Combest, Overland Park, KS (US)

(73) Assignee: MS Electronics, LLC, Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/908,168

(22) Filed: Feb. 28, 2018

(65) Prior Publication Data

US 2018/0192184 A1 Jul. 5, 2018

Related U.S. Application Data

(63) Continuation of application No. 15/229,463, filed on Aug. 5, 2016, now Pat. No. 9,936,283.

(51) Int. Cl.

| | |
|---|---|
| ***H04R 1/00*** | (2006.01) |
| ***H04R 1/28*** | (2006.01) |
| ***H04R 1/02*** | (2006.01) |
| ***H04R 3/14*** | (2006.01) |
| ***H04R 5/02*** | (2006.01) |
| *H04R 1/26* | (2006.01) |

(52) U.S. Cl.

CPC ..... *H04R 1/2803* (2013.01); *H04R 1/02* (2013.01); *H04R 3/14* (2013.01); *H04R 5/02* (2013.01); *H04R 1/26* (2013.01); *H04R 1/2811* (2013.01); *H04R 1/2842* (2013.01); *H04R 2205/024* (2013.01)

(58) Field of Classification Search

CPC . H04R 1/02; H04R 1/26; H04R 1/025; H04R 1/2811; H04R 2205/024; H04R 5/02; H04R 2201/025

See application file for complete search history.

(56) References Cited

U.S. PATENT DOCUMENTS 3,642,091 A * 2/1972 Nohara ..... H04R 1/028 181/150
5,802,193 A * 9/1998 Kieltyka ..... H04R 1/345 381/189

(Continued)

*Primary Examiner* — Matthew A Eason

(74) *Attorney, Agent, or Firm* — Hovey Williams LLP

(57) ABSTRACT

A speaker assembly broadly comprising a housing, an input circuit, and a number of speakers. The housing includes a lower section configured to be positioned at least partially below a ground surface and an upper section extending upwards from the lower section. The input circuit receives audio signals from a sound system or other controller and actively or passively sends the audio signals to the speakers. The speakers include a low-range speaker positioned in the lower section of the housing and a relatively higher-range speaker positioned in the upper section. The speaker assembly is configured to be spaced from other speaker assemblies within a listening area with each speaker assembly generating low frequency soundwaves and relatively higher-frequency soundwaves. This reduces or eliminates out-of-phase crossover frequency wave cancellation effects within the listening area.

20 Claims, 5 Drawing Sheets

(56) References Cited

U.S. PATENT DOCUMENTS

| | | | | |
|---|---|---|---|---|
| 8,873,788 | B1 * | 10/2014 | Coombs | H04R 1/2811 181/150 |
| 9,936,283 | B2 * | 4/2018 | Combest | H04R 1/2803 |
| 2012/0087529 | A1 * | 4/2012 | Coombs | H04R 1/345 381/334 |
| 2017/0311062 | A1 * | 10/2017 | Garrett | F21V 33/0056 |

* cited by examiner

OUTDOOR SPEAKER ASSEMBLY AND SYSTEM

RELATED APPLICATION

This patent application is a continuation, and claims priority benefit with regard to all common subject matter, of earlier-filed U.S. patent application Ser. No. 15/229,463, filed on Aug. 5, 2016, and entitled "OUTDOOR SPEAKER ASSEMBLY AND SYSTEM". The identified earlier filed patent application is hereby incorporated by reference in its entirety into the present application.

BACKGROUND

Outdoor speakers are often positioned near patios, decks, pools, and other outdoor areas for reproducing music, talk radio, and other audio. Conventional outdoor speaker systems often include a low-range speaker and a number of mid-range to high-range speakers spaced from the low-range speaker. The frequency ranges of the low-range speaker and the mid-range to high-range speakers often overlap, with crossover frequency soundwaves being generated by both the low range speaker and the mid-range to high-range speakers. When the speakers are spaced apart, the crossover frequency soundwaves are often out of phase with each other in portions of the listening area, thus resulting in unwanted wave cancellation or muting effects.

SUMMARY

Embodiments of the invention solve the above-mentioned problems and provide a distinct advance in the art of outdoor speaker assemblies and speaker systems. More particularly, the invention provides an outdoor speaker assembly that generates low frequency soundwaves and mid-frequency to high frequency soundwaves while reducing or eliminating out-of-phase crossover frequency wave cancellation effects when spaced from another speaker assembly within a listening area. The speaker assembly may also be at least partially buried so as to project low frequencies from below the ground, thus giving the impression of a relatively small device producing a full sound.

An embodiment of the invention is a speaker assembly broadly comprising a speaker housing, an input circuit, and a number of speakers positioned in the housing. The speaker housing includes a lower section and an upper section. The lower section includes an outer wall defining a lower chamber and an upper opening. The upper section includes an outer wall defining an upper chamber and a connector-port for connecting the upper section to the lower section via the upper opening. The connector-port has a dual function of spacing the upper chamber above the lower chamber and providing a vertically-extending channel through which low frequency sounds generated in the lower chamber are projected. The connector-port may also include a cover forming one or more downward-extending radial spaces connected to a top of the vertically-extending channel so as to increase an effective length of the connector-port. The effective length of the connector-port can also be increased by extending the connector-port into the lower chamber. This can improve low frequency performance and allows the connector-port to have an increased diameter, which minimizes port noise.

The input circuit is connected to the speakers for receiving audio signals from a sound system or other controller.

The input circuit may include an antenna, data bus, data port, or the like, and an amplifier, mixer, and/or other sound signal manipulation components.

The speakers include a low-range speaker for generating low frequency soundwaves and a relatively higher-range speaker for generating relatively higher-frequency soundwaves. The low-range speaker is configured to be positioned below a ground surface in the lower chamber of the lower section of the housing. The relatively higher-range speaker is configured to be spaced above the ground surface in the upper chamber of the upper section of the housing via the connector-port.

The speaker assembly is configured to be spaced from other speaker assemblies within a listening area with each speaker assembly generating low frequency soundwaves and relatively higher frequency soundwaves. This reduces or eliminates out-of-phase crossover frequency wave cancellation effects. That is, soundwaves of a particular crossover frequency from a low-range speaker located at a given position and soundwaves of the same crossover frequency from a relatively higher-range speaker located at the same position will not form acoustically muted regions.

Another embodiment of the invention is a speaker system broadly comprising a number of speaker assemblies configured to be spaced apart from each other within a listening area. Each speaker assembly broadly comprises a speaker housing, an input circuit, and a number of speakers. These components are substantially similar to the speaker assembly components described above. The speaker assemblies are configured to be spaced apart from each other with each speaker assembly generating low frequency and relatively higher-frequency soundwaves so as to reduce or eliminate out-of-phase crossover frequency wave cancellation effects.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
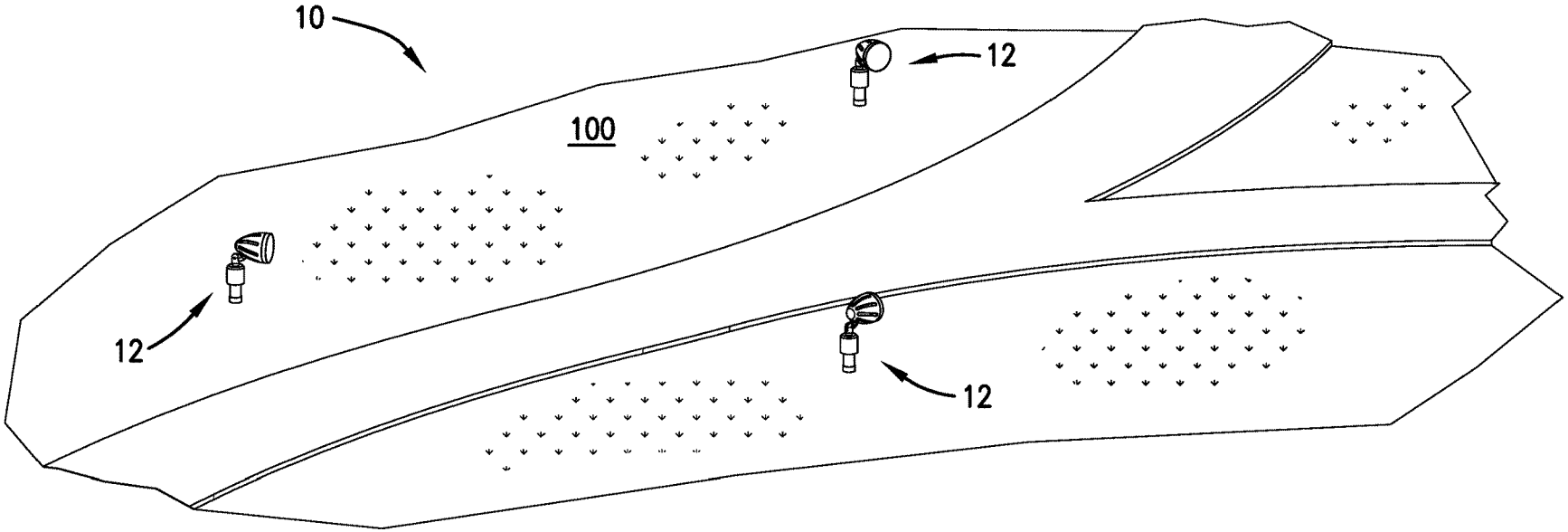
FIG. 1 is an environmental view of a speaker system constructed in accordance with an embodiment of the invention and including a number of speaker assemblies.
Figure 2:
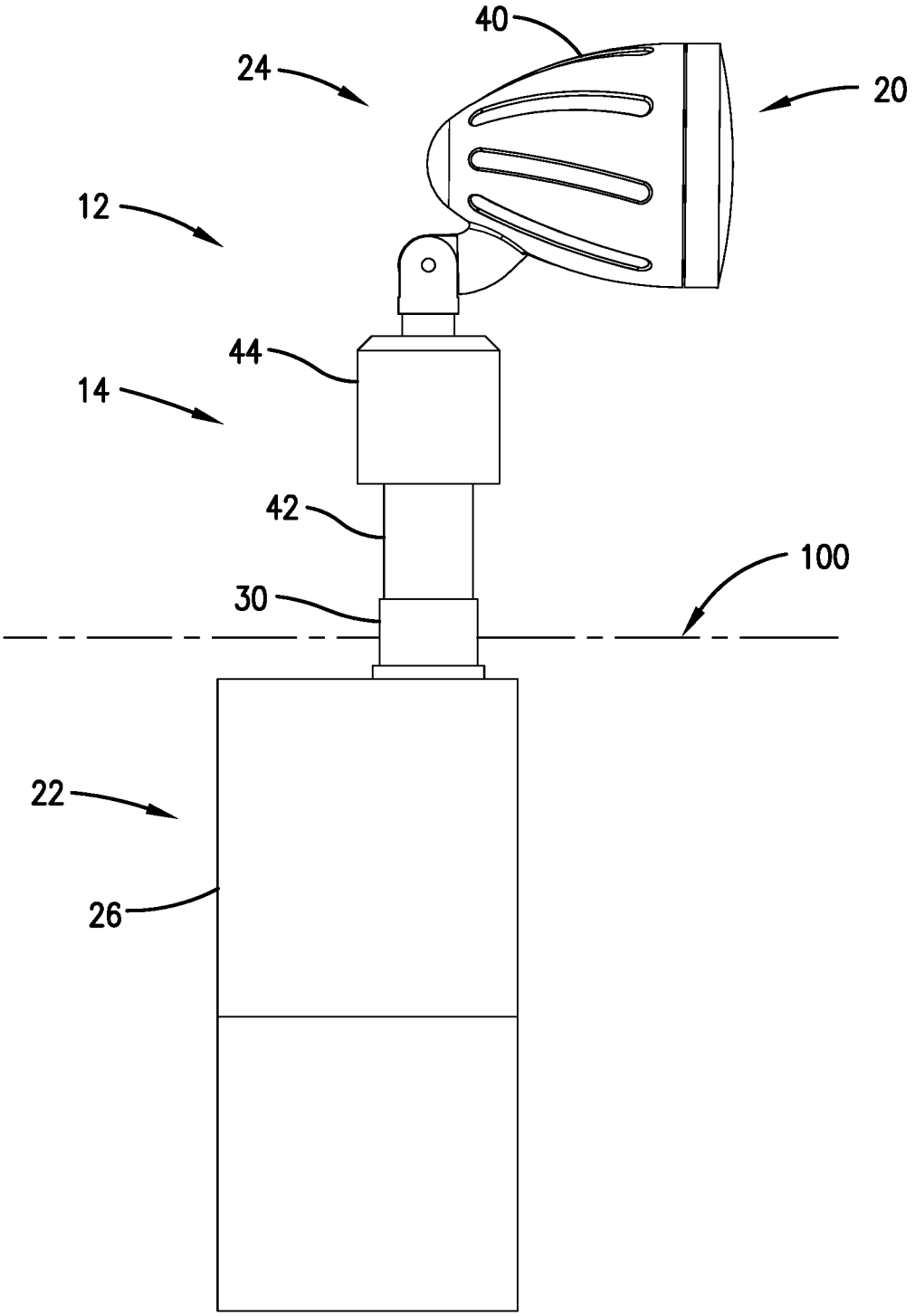
FIG. 2 is an elevation view of one speaker assembly of the speaker system shown in FIG. 1.
Figure 3:
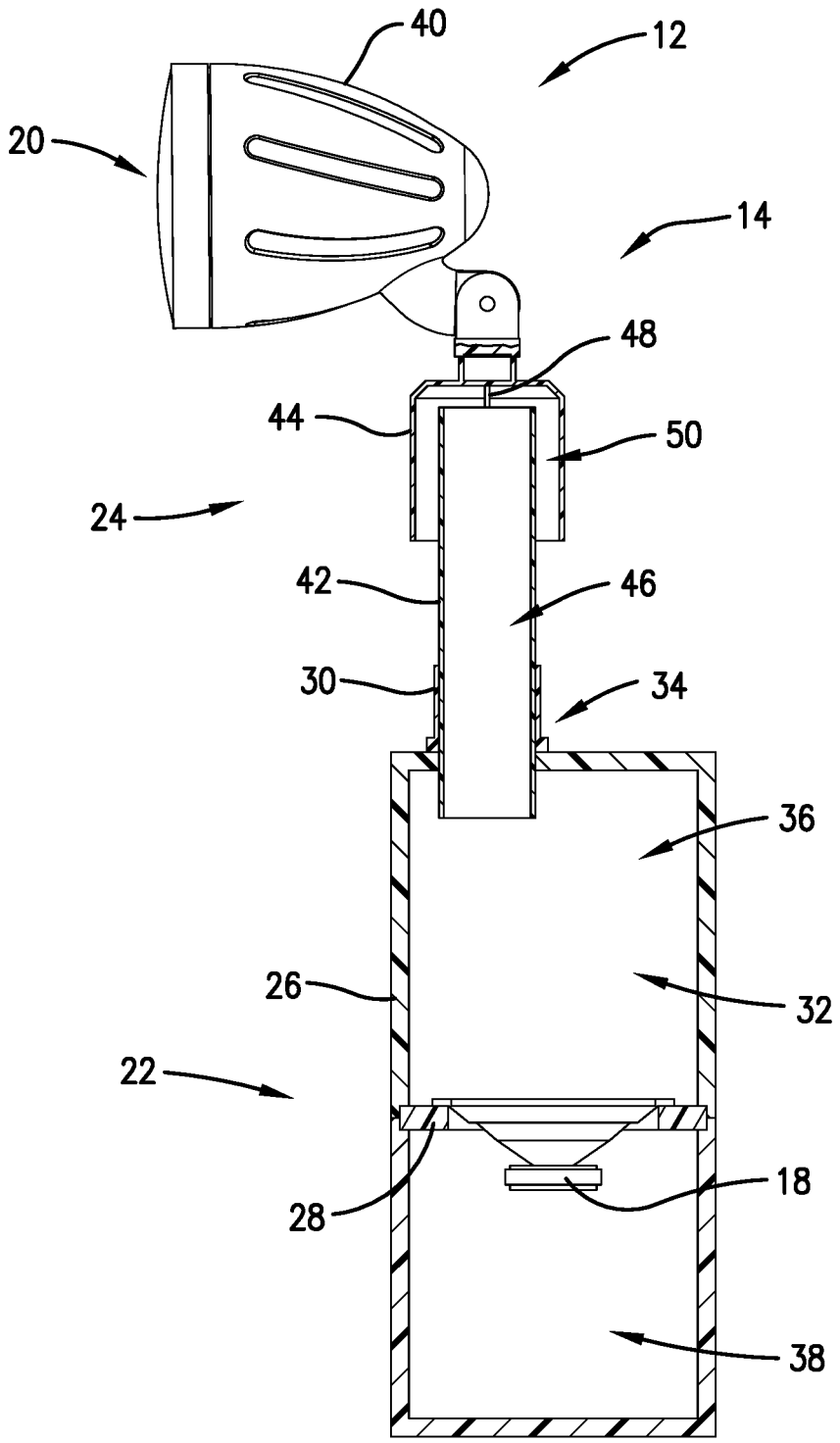
FIG. 3 is a partial cutaway elevation view of the speaker assembly of FIG. 2.

The drawing figures do not limit the present invention to the specific embodiments disclosed and described herein.

The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a landscape speaker system 10 constructed in accordance with an embodiment of the invention is illustrated. The landscape speaker system 10 broadly comprises a number of speaker assemblies 12 configured to be spaced apart from each other so as to form a listening area and at least partially positioned below a ground surface 100. The speaker assemblies 12 may be communicatively connected to a sound system 102 such as an audio receiver, radio tuner, amplifier, mixer, computer, mobile computing device, portable music player, or any other suitable audio-capable electronic device via wires or wireless communication technology such as an internet connection, Bluetooth connection, radio frequency connection, cellular network, near field communication connection, or any other suitable wireless connection.

Embodiments of the speaker assemblies 12 will now be described in more detail. The speaker assemblies 12 each broadly comprise a speaker housing 14, an input circuit 16, a low-range speaker 18, and a relatively higher-range speaker 20.

The speaker housing 14 protects the input circuit 16 and speakers 18, 20 from the environment and broadly comprises a lower section 22 and an upper section 24. The lower section 22 anchors the speaker assembly 12 and broadly comprises an outer wall 26, a divider 28, and a retainer 30. The outer wall 26 defines a lower chamber 32 for retaining the low-range speaker 18 therein and an upper opening 34 for connecting the upper section 24 to the lower section 22. The lower chamber 32 may be acoustically shaped for projecting low frequency soundwaves generated by the low-range speaker 18 upwards and/or outwards. To that end, the outer wall 26 may be cylindrical, orthogonal, spherical, or any other suitable shape. The lower chamber 32 may also have any suitable size for optimizing the projection of desired low frequency soundwaves from the lower chamber 32. The outer wall 26 may have a thickness of between one eighth of an inch and three fourths of an inch. The lower section 22 may have a diameter of between five inches to twelve inches and a height of between ten inches and twenty inches. In one embodiment, the lower section 22 has a diameter of six inches and a height of fourteen and one quarter inches. The small diameter of the lower section 22 allows a hole for the lower section 22 to be dug with a manual post hole digger or small powered corkscrew digger. The lower section 22 may be formed of PVC or other plastic, metal, or any other suitable material and may be waterproof and/or corrosion resistant.

The divider 28 extends horizontally in the lower chamber 32 and partitions the lower chamber 32 into an upper sub-chamber 36 and a lower sub-chamber 38. The divider 28 also supports the low-range speaker 18 such that the low-range speaker 18 is spaced from a bottom of the lower section 22 and projects low frequency soundwaves upwards into the upper sub-chamber 36. The divider 28 may be spaced from a bottom of the lower section 22 between three inches and fifteen inches and spaced from a top of the lower section 22 between three inches and fifteen inches. In one embodiment, the divider 28 is spaced six inches from the bottom of the lower section 22 and spaced seven inches from the top of the lower section 22. That is, the divider 28 may be positioned at any suitable height above the bottom of the lower section 22 for optimizing the projection of desired low frequency soundwaves from the lower chamber 32.

The retainer 30 retains the upper section 24 in a fixed position relative to the lower section 22 and may be positioned near and aligned with the upper opening 34. The retainer may be a threaded fastener, a mounting boss, a flange, or other similar connection point. In one embodiment the retainer 30 is a cylindrical friction-fit cuff. The retainer 30 may be formed of PVC or other plastic, metal, or any other suitable material and may be waterproof and/or corrosion resistant.

The upper section 24 houses the relatively higher-range speaker 20 and broadly comprises an outer wall 40, a connector-port 42, and a cover 44. The outer wall 40 includes an upper chamber for at least partially retaining the relatively higher-range speaker 20 therein and may be ergonomically shaped and/or acoustically shaped for improving projection of mid-range to high-range frequencies. In one embodiment, the outer wall 40 may have a tear-drop or cone shape. The outer wall 40 may be formed of plastic, metal, and/or any other suitable waterproof and/or corrosion resistant material. The outer wall 40 may be pivotable about a horizontal axis in relation to the lower section 22 for directionally aiming the relatively higher-range speaker 20 along a vertically extending plane.

The connector-port 42 extends between the lower section 22 and the outer wall 40 of the upper section 24 and serves a dual purpose of spacing the relatively higher-range speaker 20 above the ground surface 100 and improving projection of low frequency sounds from the lower chamber 32. The connector-port 42 forms an open-ended vertically extending through-channel 46 for allowing low frequency soundwaves to be projected upwards therethrough. The connector-port 42, and hence the through-channel 46, may have any suitable length and diameter for optimizing projection of low frequency soundwaves and minimizing port noise by preventing air velocity within the through-channel 46 from being too high. To that end, the connector-port 42 may have a height of between three inches and twenty inches. In one embodiment, the connector-port 42 has a height of nine inches. The connector-port 42 may be inserted a predetermined amount into the upper opening 34 of the lower section 22, for increasing the effective length of the connector-port, and may be positively or frictionally held in place via the retainer 30. That is, the connector-port 42 may partially extend into the lower chamber 32 such that the relatively higher-range speaker 20 is close to the ground surface 100 while providing a relatively long port for the low frequency speaker 18. The connector-port 42 may be rotatable about a horizontal axis in relation to the lower section 22 for directionally aiming the relatively higher-range speaker 20 along a horizontally extending plane. The connector-port 42 also serves as a post for the relatively-higher range speaker 22 to be mounted thereon. As such, the effective height of the connector-port 42 may be minimized, so that the relatively-higher range speaker 22 is not mounted too high, while a path of the low frequency soundwaves is maximized.

The cover 44 extends over the connector-port 42 and may be cylindrical or cup-shaped for preventing precipitation and debris from entering the channel 46 of the connector-port 42 and lower chamber 32 of the lower section 22. The cover 44 may include a number of ribs 48 extending radially inward for engaging the connector-port 42 and forming a number of radial spaces 50 connected to a top of the channel 46 and extending downward around the channel 46. The spaces 50 allow low frequency soundwaves generated by the low-range speaker 18 to pass therethrough from the channel 46. Importantly, the cover 44 and space 50 provide a fold-back path for the low frequency waves to travel from the lower chamber 32. That is, the effective length of the path can be increased by increasing the length of the cover 44 without increasing the height of the connector-port 42. The effective length of the path could also be increased by 2-to-1 for every increase in length of the connector-port 42 and cover 44. Increasing the path length can improve projection of lower frequencies. The cover 44 may be positioned between one inch and 12 inches above the ground surface 100. In one embodiment, the cover 44 is spaced three inches above the ground surface 100.

The input circuit 16 receives audio signals from the sound system 102 and actively or passively sends the audio signals to the speakers 20, 22. The input circuit 16 may include an antenna, data bus, data port, or any other suitable communication component, an amplifier, mixer, or any other sound signal manipulation component. The input circuit 16 may be positioned in the lower section 22, or any part of the upper section 24 for improving signal reception.

Figure 4:
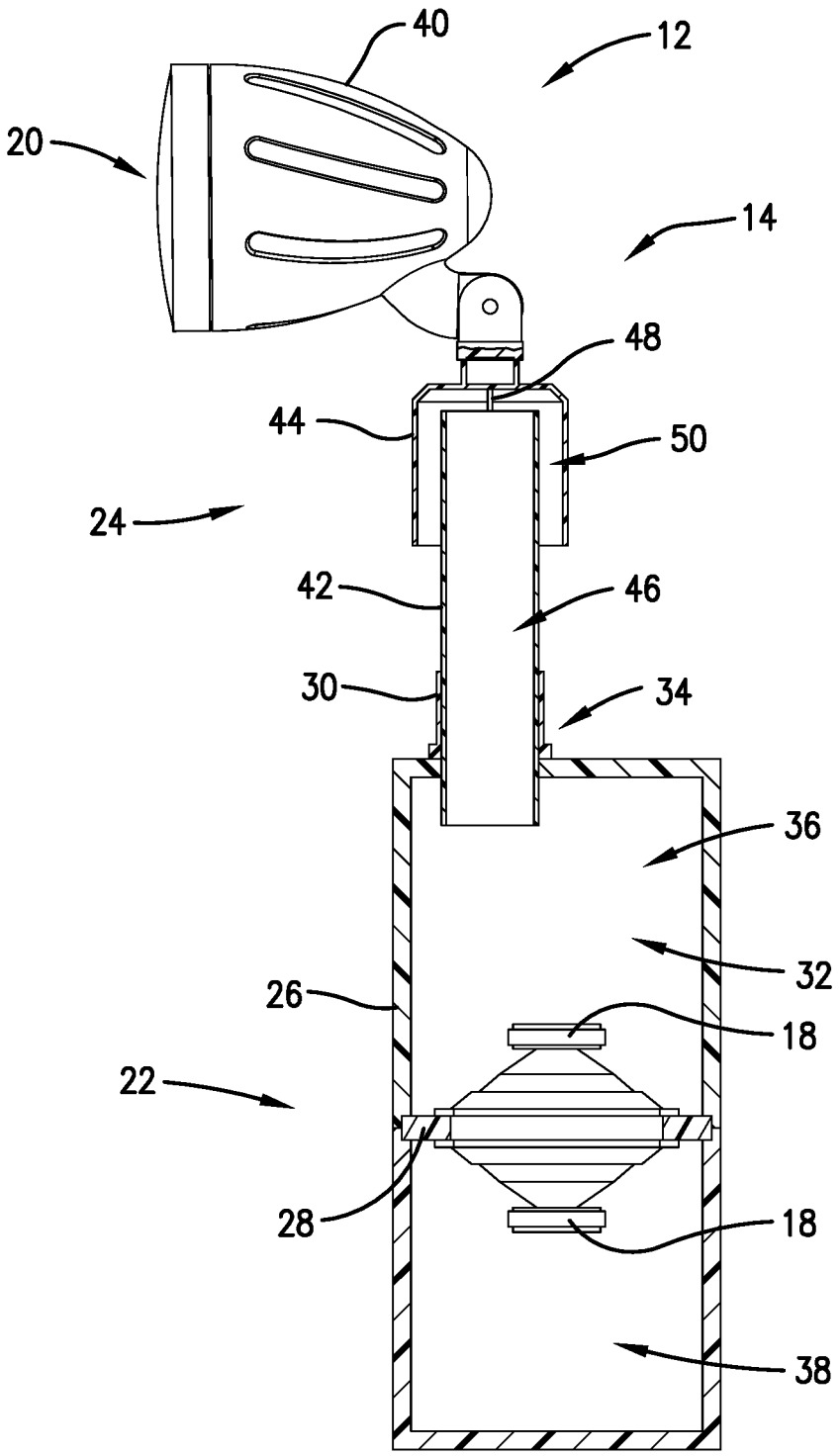
FIG. 4 is a partial cutaway elevation view of the speaker assembly of FIG. 2 including two low-range speakers.
Figure 6:
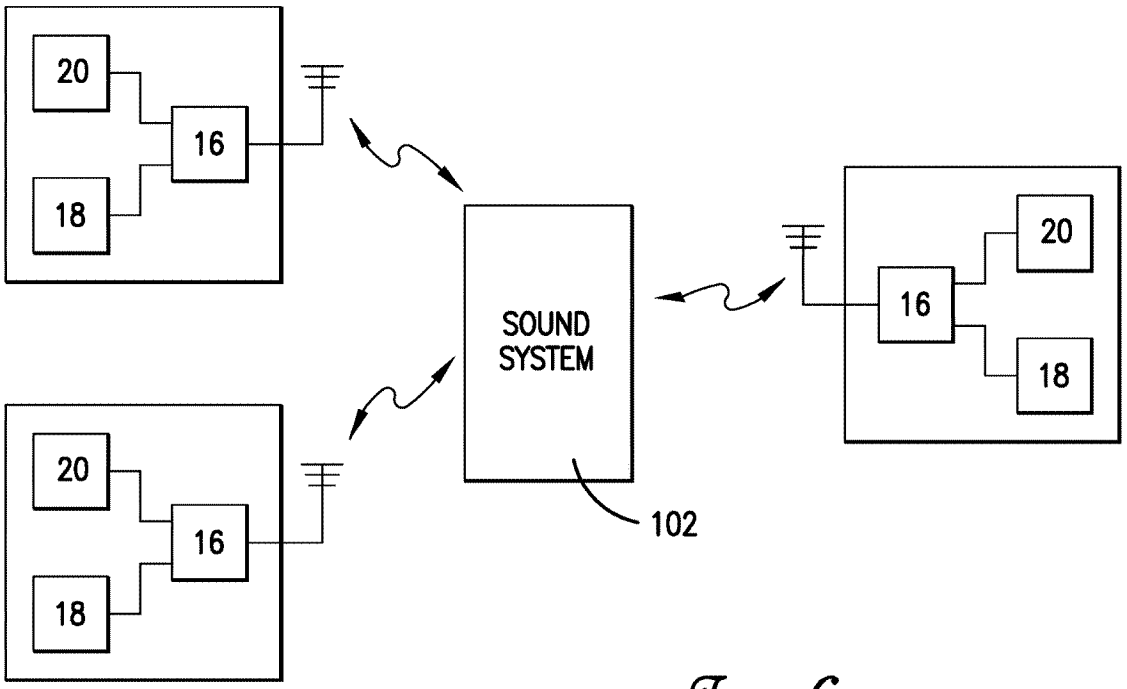
FIG. 6 is a block diagram of the speaker system of FIG. 1 in wireless communication with a sound system in accordance with another embodiment of the invention.
Figure 5:
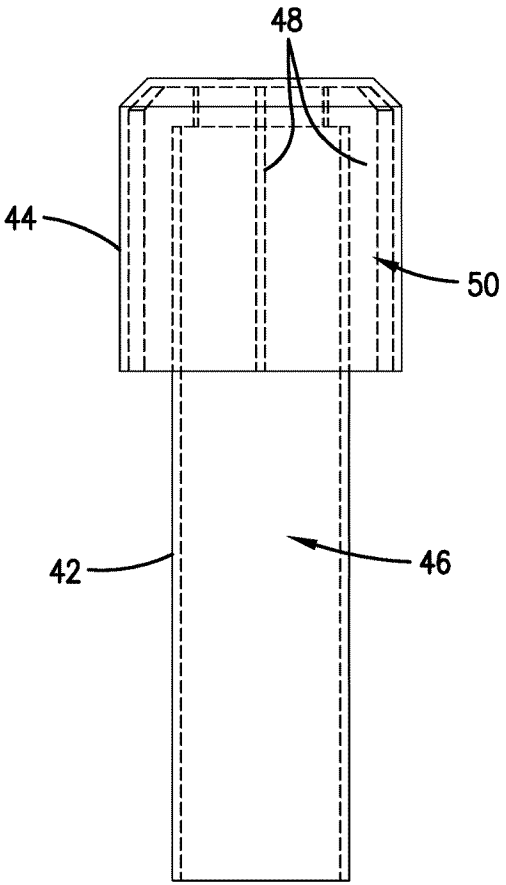
FIG. 5 is a cutaway elevation view of a connector-port and cover of the speaker assembly of FIG. 2.

The low-range speaker 18 generates low frequency soundwaves and may be a woofer, subwoofer, bass speaker, or other low-range speaker. The low-range speaker 18 may be positioned in or mounted to the divider 28 and aimed upwards or downwards for projecting the low frequency soundwaves through the upper sub-chamber 36 and the channel 46 of the connector-port 42. Alternatively, two low-range speakers 18 may be positioned in or mounted to the divider 28 and optionally facing each other, as shown in FIG. 4.

The relatively higher-range speaker 20 generates mid-frequency and/or high frequency soundwaves and may be a midwoofer, tweeter, or any other similar speaker. The relatively higher-range speaker 20 may be aimed in virtually any direction via rotation of the connector-port 42 and pivoting of the outer wall 40. For example, the relatively higher-range speaker 20 may be pointed between zero degrees and eighty-nine degrees towards a walking path to project mid-frequency to high frequency soundwaves towards a passerby.

Use of the above-described speaker system 10 will now be described in more detail. First, the speaker assemblies 12 may be spaced apart from each other throughout the listening area such that low frequency soundwaves and mid-frequency to high frequency soundwaves can be received from at least one of the speaker assemblies 12 for most and/or key regions of the listening area. In this way, soundwaves of a particular crossover frequency from a low-range speaker located at a given position and soundwaves of the same crossover frequency from a relatively higher-range speaker located at the same position will not form acoustically muted regions. The lower section 22 of each speaker assembly 12 may then be positioned below the ground surface 100 such that the upper sections 16 extend upwards from the ground surface 100.

The connector-ports 42 of the upper sections 16 may then be urged into the upper openings 32 of the lower sections 14 so as to selectively adjust a vertical height of the relatively higher-range speakers 20. Alternatively, the connector-ports 42 may be fixed at a predetermined vertical position relative to the lower section 22 via glue or any other suitable fastener during manufacturing. The upper sections 16 may then be rotated about a vertically extending axis in relation to the bases 14 so as to selectively direct the mid-frequency to high frequency soundwaves in desired horizontal directions. The outer walls 38 of the upper sections 16 may then be pivoted vertically about a horizontally extending axis so as to selectively direct the mid-frequency to high frequency soundwaves at desired vertical angles. For example, the relatively higher-range speakers 20 may be positioned approximately nine inches above the ground surface 100, directed perpendicular to a walking path, and aimed upwards at approximately forty-five degrees so that mid-frequency to high frequency soundwaves are focused towards an average human ear height above the walking path. In this way, low frequency soundwaves are received from each speaker assembly 12 and mid-frequency to high frequency soundwaves are directed for optimized listening.

The above-described speaker system 10 provides many advantages over conventional speaker systems. For example, each speaker assembly 12 includes a low-range speaker 18 in addition to a relatively higher-range speaker 20. This reduces or eliminates out-of-phase crossover frequency wave cancellation effects within listening areas of the speaker system 10. That is, soundwaves of a particular crossover frequency from a low-range speaker located at a given position and soundwaves of the same crossover frequency from a relatively higher-range speaker located at the same position will not form acoustically muted regions. The lower section 22 of each speaker assembly 12 can also be set in or buried below the ground surface 100 such that only the upper section 24 is visible and/or extends above the ground surface 100 while the low frequency soundwaves are still projected upwards through the channel 46 of the connector-port 42. This gives the impression of a relatively small device producing a full sound. The cover 44 also prevents precipitation and debris from entering the lower chamber 32 while allowing low frequency soundwaves to continue outwards through the spaces 50 created by the ribs 48. The effective length of the path that low frequency soundwaves travel through the speaker assembly 12 may be increased without increasing the height of speaker assembly 12 and without introducing "port noise", which can improve the sound quality of the speaker assembly 12. The relatively higher-range speakers 22 can also be aimed in virtually any direction, thus allowing the output of the speaker system 10 to be optimized for the intended listening area.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An outdoor speaker assembly comprising:
a speaker housing including:
a lower section; and
an upper section connected to and spaced above the lower section;
a low-range speaker positioned in the lower section for generating low frequency soundwaves; and
a relatively higher-range speaker positioned in the upper section for generating relatively higher frequency soundwaves,
the lower section of the housing being configured to be positioned below a ground surface such that the upper section is positioned above the ground surface, the speaker assembly being configured to be spaced from other speaker assemblies such that each speaker assembly produces low frequency soundwaves and relatively higher frequency soundwaves so as to reduce out-of-phase crossover frequency wave cancellation effects within a listening area of the speaker assembly.

2. The speaker assembly of claim 1, wherein the lower section defines a lower chamber and includes a divider configured to vertically partition the lower chamber into a lower sub-chamber and an upper sub-chamber, the low-range speaker being configured to be mounted to the divider such that low frequency soundwaves are projected upwards through the upper sub-chamber.

3. The speaker system of claim 2, further comprising a second low-range speaker mounted to the divider.

4. The speaker system of claim 1, further comprising a connector-port connecting the lower section to the upper section for allowing soundwaves to pass upwards therethrough from the lower section.

5. The speaker system of claim 4, wherein the lower section further comprises a retainer for receiving the connector-port therein.

6. The speaker assembly of claim 4, wherein the connector-port includes a cover.

7. The speaker assembly of claim 6, wherein the cover comprises a number of ribs forming a radial space for increasing a length of an effective path of the low frequency soundwaves through the connector-port.

8. The speaker assembly of claim 7, wherein the radial space extends downward from a top of the connector-port.

9. An outdoor speaker system comprising:
a plurality of speaker assemblies each comprising:
a speaker housing including:
a lower section; and
an upper section connected to and spaced above the lower section;
a low-range speaker positioned in the lower section for generating low frequency soundwaves; and
a relatively higher-range speaker positioned in the upper section for generating relatively higher frequency soundwaves,
the lower section of the housing being configured to be positioned below a ground surface such that the upper section is positioned above the ground surface, the speaker assembly being configured to be spaced from other speaker assemblies such that each speaker assembly produces low frequency soundwaves and relatively higher frequency soundwaves so as to reduce out-of-phase crossover frequency wave cancellation effects within a listening area of the speaker assembly.

10. The speaker system of claim 9, wherein the lower section of the speaker housing defines a lower chamber and further comprises a divider configured to vertically partition the lower chamber into a lower sub-chamber and an upper sub-chamber, the low-range speaker being configured to be mounted to the divider such that low frequency soundwaves are projected upwards through the upper sub-chamber.

11. The speaker system of claim 10, further comprising a second low-range speaker mounted to the divider.

12. The speaker system of claim 9, wherein the upper section is rotatable about a vertical axis in relation to the lower section for directionally aiming the relatively higher-range speaker along a horizontally extending plane.

13. The speaker system of claim 9, wherein each speaker assembly further comprises a connector-port connecting the lower section to the upper section for allowing soundwaves to pass upwards therethrough from the lower section.

14. The speaker system of claim 13, wherein the lower section further comprises a retainer for receiving the connector-port therein.

15. The speaker system of claim 14, wherein the connector-port and retainer are formed of PVC pipe.

16. The speaker system of claim 13, wherein the connector-port includes a cover.

17. The speaker system of claim 16, wherein the cover comprises a number of ribs forming a radial space for increasing an effective path of the low frequency soundwaves through the connector-port.

18. The speaker system of claim 17, wherein the radial space extends downward from a top of the open-ended channel.

19. The speaker system of claim 9, wherein the upper section is pivotable about a horizontal axis in relation to the lower section for directionally aiming the relatively higher-range speaker along a vertically extending plane.

20. A method of installing a speaker system, the method comprising the steps of:
obtaining a number of speaker assemblies each comprising:
a speaker housing including:
a lower section; and
an upper section connected to and spaced above the lower section;
a low-range speaker positioned in the lower section for generating low frequency soundwaves; and
a relatively higher-range speaker positioned in the upper section for generating relatively higher frequency soundwaves;
spacing the speaker assemblies from each other such that each speaker assembly produces low frequency soundwaves and relatively higher frequency soundwaves so as to reduce out-of-phase crossover frequency wave cancellation effects within a listening area of the speaker system; and
positioning each lower section below a ground surface such that the upper sections are positioned above the ground surface.

* * * * *